US008198814B2

(12) United States Patent
Werner et al.

(10) Patent No.: US 8,198,814 B2
(45) Date of Patent: Jun. 12, 2012

(54) HIGH PRESSURE SODIUM LAMP WITH A SHIELDING MEMBER BETWEEN TWO ARC TUBES

(75) Inventors: Björn Werner, Solna (SE); Mikael Severinsson, Rödeby (SE)

(73) Assignee: Auralight International AB (SE)

( * ) Notice: Subject to any disclaimer, the term of this patent is extended or adjusted under 35 U.S.C. 154(b) by 0 days.

(21) Appl. No.: 12/601,441

(22) PCT Filed: May 23, 2008

(86) PCT No.: PCT/SE2008/050611

§ 371 (c)(1),
(2), (4) Date: Jun. 16, 2010

(87) PCT Pub. No.: WO2008/143587

PCT Pub. Date: Nov. 27, 2008

(65) Prior Publication Data

US 2010/0253219 A1 Oct. 7, 2010

(30) Foreign Application Priority Data

May 24, 2007 (SE) ..... 0701251

(51) Int. Cl.
*H01J 61/10* (2006.01)
*H01J 61/06* (2006.01)
*H01J 61/34* (2006.01)

(52) U.S. Cl. ..... 313/626; 313/25; 313/634; 313/635

(58) Field of Classification Search ..... None
See application file for complete search history.

(56) References Cited

U.S. PATENT DOCUMENTS

| | | | | | |
|---|---|---|---|---|---|
| 3,484,637 | A | * | 12/1969 | Boort et al. | 313/25 |
| 3,780,331 | A | | 12/1973 | Knochel et al. | |
| 4,287,454 | A | | 9/1981 | Feuersanger et al. | |
| 4,333,032 | A | | 6/1982 | Wyner et al. | |
| 4,843,266 | A | * | 6/1989 | Szanto et al. | 313/25 |
| 5,064,395 | A | * | 11/1991 | Kling et al. | 445/27 |
| 5,173,632 | A | * | 12/1992 | Dolan et al. | 313/25 |
| 5,248,913 | A | | 9/1993 | Heider | |
| 5,276,385 | A | | 1/1994 | Itoh et al. | |
| 5,291,092 | A | * | 3/1994 | Coushaine | 313/318.01 |
| 5,408,157 | A | * | 4/1995 | Alderman et al. | 313/25 |

(Continued)

FOREIGN PATENT DOCUMENTS

| | | | |
|---|---|---|---|
| DE | 9002959 | U1 | 6/1990 |
| EP | 0160972 | A2 | 11/1985 |
| WO | WO-01/39246 | A1 | 5/2001 |

OTHER PUBLICATIONS

"International Application Serial No. PCT/SE2008/050611, International Search Report mailed Aug. 26, 2008", 9 pgs.

(Continued)

*Primary Examiner* — Sikha Roy
(74) *Attorney, Agent, or Firm* — Schwegman, Lundberg & Woessner, P.A.

(57) ABSTRACT

The present invention relates to a high pressure sodium lamp comprising an evacuated cover including a base part, an arc tube comprising a first and a second electrode each being connected to the base part via conductor members. At least one conductor member is arranged isolated by a shielding member for preventing, during operation of the high pressure sodium lamp, the photo electronic stream from the at least one conductor member to the arc tube. The lamp comprises a second arc tube.

8 Claims, 3 Drawing Sheets

U.S. PATENT DOCUMENTS

| | | | | |
|---|---|---|---|---|
| 5,661,367 | A * | 8/1997 | Fellows et al. | 315/59 |
| 5,729,091 | A * | 3/1998 | Barthelmes et al. | 313/638 |
| 6,133,677 | A * | 10/2000 | Shippee et al. | 313/25 |
| 6,429,588 | B1 * | 8/2002 | Guenther et al. | 313/594 |
| 2009/0015162 | A1 * | 1/2009 | Bernard et al. | 313/625 |

OTHER PUBLICATIONS

"Chinese Application Serial No. 200880017114.X, Office Action dated Oct. 12, 2010", 2 pgs.

"Chinese Application Serial No. 200880017114.X, Response filed Feb. 28, 2011 to Office Action dated Oct. 12, 2010", (w/ English Translation of Amended Claims), 5 pgs.

"International Application Serial No. PCT/SE2008/050611, International Preliminary Report on Patentability issued Nov. 24, 2009", 10 pgs.

"International Application Serial No. PCT/SE2008/050611, Written Opinion mailed Aug. 26, 2008", 9 pgs.

* cited by examiner

HIGH PRESSURE SODIUM LAMP WITH A SHIELDING MEMBER BETWEEN TWO ARC TUBES

PRIORITY CLAIM TO RELATED APPLICATIONS

This application is a national stage application under 35 U.S.C. §371 of PCT/SE2008/050611, filed May 23, 2008, and published as WO 2008/143587 A1 on Nov. 27, 2008, which claims priority to Swedish Application No. 0701251-1, filed May 24, 2007, which applications and publication are incorporated herein by reference and made a part hereof in their entirety, and the benefit of priority is claimed thereto.

FIELD OF THE INVENTION

The present invention relates to a high pressure sodium lamp according to the preamble of claim 1. The invention relates, but not limited, to lamp manufacturing industry.

BACKGROUND OF THE INVENTION

High pressure sodium lamp (HPS) may have an elongated arc tube being enclosed within an evacuated glass cover, wherein the arc tube houses the HPS lamp's electrodes. The HPS lamp has thus a vacuum inside the glass cover (glass bulb) to isolate the arc tube from changes in the ambient temperature. The arc tube may be made of a translucent oxide and a strong discharge takes place under high temperature and pressure. The arc tube's electrodes are connected to the lamp base via conductors, provided within the glass cover.

HPS lamps are available in wattages from 35 up to 1000 watts, but the most common wattages are lying between 50 to 400 watts. One 1000 watt HPS lamp can alone produce over 140 000 lumens, with a light efficiency greater than 150 lm/W. A regular HPS lamp requires between 2500 and 4000 V starting pulse to ignite. The standard operating conditions for HPS lamps in an AC-voltage network require a supply voltage of 230 V/50 Hz. HPS lamps are in general very sensitive for deviations in the main voltage supply.

A HPS lamp is disclosed in U.S. Pat. No. 4,333,032. This HPS lamp is designed to solve the problem with sodium depletion with the arc tube, shortening the life of the lamp. The construction of U.S. Pat. No. 4,333,032 has a barium film disposed on the inner wall of the glass cover at a predetermined distance, attracting photoelectrons to the lamps lead-in conductor instead of to the arc tube.

The object of the present invention is also to achieve a HPS lamp with a long life performance. It is also an object to provide a HPS lamp which ensures that the critical lighting applications will stay lit, even after momentary power outages. Another object is also to provide a HPS lamp that ensures a lower incline of the light output and a HPS lamp involving an increased color rendering.

The object of the present invention is thus to overcome the drawbacks of known techniques.

SUMMARY OF THE INVENTION

This has been solved by the HPS lamp being defined in the introduction, wherein the HPS lamp is characterised by the features of claim 1's characterising part.

Thereby the diffusion of sodium ions from the arc tube, due to the high temperature and high pressure inside the arc tube, can be reduced. It has been shown that the photo electronic stream from the metal conductor (can also be used as a metal mount structure for the arc tube) will be reduced up to 90%. Since the sodium loss (the diffusion of sodium ions) from the arc tube depends on the amount of liberation of negative ions from the metal conductor, the sodium loss will be very small, when the shielding member shields the metal conductor such that the metal conductor is not exposed to the arc tube, Thus, the negative recharging affecting the positive sodium ions of the arc tube will be less. This will lead to a smaller diffusion of sodium ions from the arc tube increasing the high pressure sodium lamp's life, and at the same time this reduction of ion absorption will reduce the blackening of the arc tube and the inner side of the glass cover resulting in a lower decline of the light output.

Preferably, the high pressure sodium lamp comprises a second arc tube.

In such a way a high pressure sodium lamp is provided with dual arc tubes. This provides even longer life cycle for the high pressure sodium lamp. This second arc tube assures that the critical lightning applications will stay lit, even after momentary power outages. Since only one arc tube at a time is active (burning), the dual arc tube solution doubles the life time of the high pressure sodium lamp. The arc tube with the lowest interior pressure will ignite first, whereby the other remains turned out. In case of momentary power outage, the other arc tube will more easily ignite because this has not been burning making it's temperature, and thereby it's pressure, lower than the previous burning arc tube. Due to the shielding member providing for the reduction of blackening of the arc tube as being discussed above, the temperature of the arc tube to be ignited will be even lower and thereby the high pressure sodium lamp will more easily ignite in case of momentary power outage. This beneficial when the high pressure lamp is mounted in a streetlighting luminaire/fitting and the street traffic is depended upon the production of light.

Suitably, the shielding member is a cylinder made of ceramic material, surrounding the at least one conductor member.

Thus the ceramic cylinder reduces the sodium loss from the burning arc tube, reducing the temperature on the outer glass cover and reduces the blackening on the latter. The ceramic cylinder is easy to mount and is held on place without the need of additional fittings.

Preferably the ceramic is steatite.

Thereby the photo electronic stream from the metal conductor is reduced up to 90%, efficiently reducing the loss of sodium from the active arc tube.

Suitably, the at least one conductor member serves as a mounting structure having a part abutting against the portion of the cover opposite the base part.

Thereby the mounting of the arc tube within the lamp cover can be achieved by an integrated conductor/mounting structure being fixed within the cover.

Preferably, the arc tube comprises xenon under a high gas pressure of about 120-150 mbar, preferably 130-140 mbar.

In such a way a long life HPS lamp is achieved. The high pressure arc tube can be used, or preferably within the same glass cover two or more arc tubes having said high pressure for achieving longer life. The usage of the high pressure arc tube is critical since high pressure involves larger leakage of sodium, but due to the application of the shielding member reducing the loss of sodium the long life is achieved. The selection of xenon as filling gas reduces the thermal conductivity, minimizes the sputtering from the electrodes during the initial running of the HPS lamp. The higher gas pressure in the arc tube increases the lamp life, the lamp's color rendering and it's light output.

BRIEF DESCRIPTION OF THE DRAWINGS

The present invention will now be described by way of example with reference to the accompanying schematic drawings of which.

DETAILED DESCRIPTION OF THE PREFERRED EMBODIMENTS

Hereinafter, embodiments of the present invention will be described in detail with reference to the accompanying drawings related to embodiments, wherein for the sake of clarity and understanding of the invention some details of no importance are deleted from the drawings.

Figure 1:
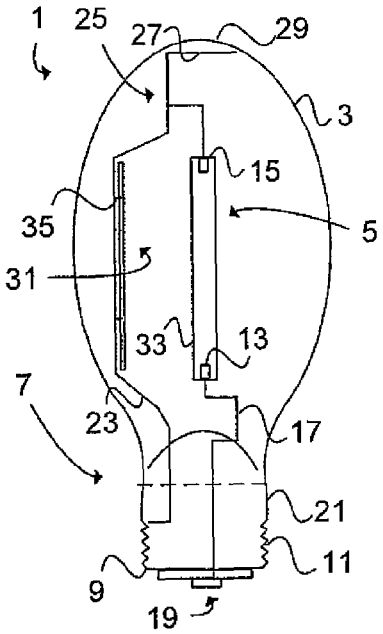
FIG. 1 is a side view of a HPS lamp according to a first embodiment.

Referring to FIG. 1 a HPS lamp (high pressure sodium lamp) 1 is shown according to a first embodiment. An outer bulb, or glass cover 3, encloses a ceramic arc tube 5. The glass cover 3 is evacuated and is in vacuum. At the bottom end of the glass cover 3 is arranged a base part 7 constituting a socket 9 having a thread 11 for mounting in an armature (not shown). The arc tube 5 has a first electrode 13 and a second electrode 15 (acting as cathodes) and is provided with a xenon starting gas together with a sodium-mercury amalgam composition.

The first electrode 13 is connected to the base part 7 via a first conductor wire 17 of metal and is arranged in electrical contact with the socket's 9 mid part 19. The second electrode 15 is connected to the socket's 9 sleeve 21 via a second rigid conductor wire 23 of metal, also constituting a mounting structure 25 bearing the arc tube 5 centrally in the glass cover 3. The mounting structure 25 has a part 27 abutting against an upper portion 29 of the inside of the glass cover 3 opposite the base part 7.

The second conductor metal wire 23 is arranged shielded (or isolated) by a shielding member 31 for preventing, during operation of the HPS lamp 1, a photo electronic stream released from the conductor member, i.e the second conductor wire 23, to the arc tube 5. The shielding member 31 is arranged parallel with the arc tube 5 and essentially with the same extension. Thereby sodium losses from the arc tube 5 are reduced, since the photo electronic stream of negative ions from the second conductor metal wire 23, otherwise attracting to the outside of the arc tube's 5 wall 33 absorbing the sodium ions, will be prevented (or at least considerable hindered). The shielding member 31 is attached to the wire 23 by clips 35 and is adapted to shield the wire 23 such that it stops the photo electronic stream to the arc tube 5, but is, at the same time, not so wide that it blocks the light generated from the arc tube 5 during operation.

The volume between the arc tube 5 and the glass cover 3 is in vacuum and reduces convection and heat losses from the arc tube 5 to maintain high efficacy. The pressure in the glass cover 3 is typically about 7 Pa in a cold state.

Getters (not shown) are used in the HPS lamp 1 for avoiding harmful gaseous impurities which otherwise for example would shorten the HPS lamp 1's life and it's luminous efficacy. The getters bind and capture the gaseous molecules to maintain a clean atmosphere inside the glass cover 3.

Figure 2:
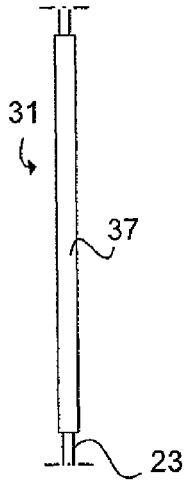
FIG. 2 is a view of a shielding member in the form of a ceramic cylinder.

FIG. 2 is a view of a shielding member 31 in the form of a ceramic cylinder 37 made of steatite according to a second embodiment. The ceramic cylinder 37 is easy to mount during assembly of the HPS lamp 1 making the manufacturing cost effective. The ceramic cylinder 37 is thread onto the second conductor wire 23 before this wire is bent into the desired shape.

Figure 3:
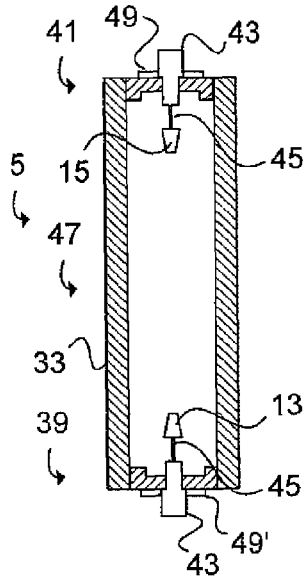
FIG. 3 is a cross section of an arc tube of the HPS lamp in FIG. 1.

FIG. 3 schematically shows the cross section of the arc tube 5 of the HPS lamp 1 in FIG. 1. Xenon gas pressure in an arc tube, when the lamp is cold, is in a common HPS lamp slightly less than 2.7 kPa. In the FIG. 3's embodiment the arc tube 5 has a gas pressure of 27 kPa. This higher pressure increases the HPS lamp 1's color rendering, it's light output and its life time. Because of the extremely high chemical activity of the HPS lamp 1, the arc tube 5 is typically made of translucent aluminium oxide (alumina). The arc tube 5 is enclosed in the glass cover 3 and contains xenon as a starting gas, sodium and mercury. The mercury is in the form of amalgam with the sodium. The arc tube 5 is thus designed for withstanding high temperatures and resisting the corrosive effects of hot sodium. Maximum temperature of the arc tube 5 is about 1100° C. with a sodium amalgam reservoir temperature about 70° C. In this application the arc tube 5 is defined as a high pressure arc tube. A plasma arc column (not shown) of the high pressure arc tube 5 has during operation a total pressure of sodium, mercury and inert gas of typically slightly less than 1 atm. ($10^5$ Pa).

Also other gases may be used as a starting gas, such as argon and neon. The choice of xenon is mainly preferred because it reduces the HPS lamp current and because it reduces the thermal conductivity, minimizes the sputtering from the electrodes 13, during the initial running of the HPS lamp 1. Additionally, xenon produces an emission band at 560 nm and an enhancement of the red shoulder of the 589 nm line, which gives a contribution to an improvement in the luminous efficacy of the discharge. Mercury vapor also reduces the heat conduction losses, improves the color rendering and increases the electrical conductivity of the discharge. Mercury amalgams very easily with sodium and the amalgam is much easier to handle than pure sodium.

The arc tube 5 in FIG. 3 comprises the first 13 and second 15 electrode arranged in a bottom part 39 and in a top part 41 respectively. Each electrode 13, 15 comprises a niobium tube 43 holding a pin 45 of tungsten with the electrode 13, 15 being welded together with each of the niobium tube 43. The arc tube 5 comprises a PCA tube 47 (translucent Polycrystalline Alumina tube) having it's ends enclosed by the bottom 39 and top part 41 comprising the through mounted electrodes 13, 15. The bottom and top parts 39, 41 are of the same translucent ceramic material as the PCA tube 47 and are melted together with it. When assembling the arc tube 5 and the electrodes 13, 15, one of the niobium tubes 43 with it's electrode 15 is brought into the arc tube 5 through a hole in the top part 41 and solder together with the top part 41 by a ceramic frit ring 49. Thereafter amalgam is added into the arc tube 5 and the other niobium tube 43 with it's electrode 13 is mounted at the bottom. Before solder the niobium tube 43 and the bottom part 39 together, the arc tube 5 is filled with the xenon starting gas. When reaching desired pressure a second fit ring 49' is melted and seals the arc tube 5.

Figure 4:
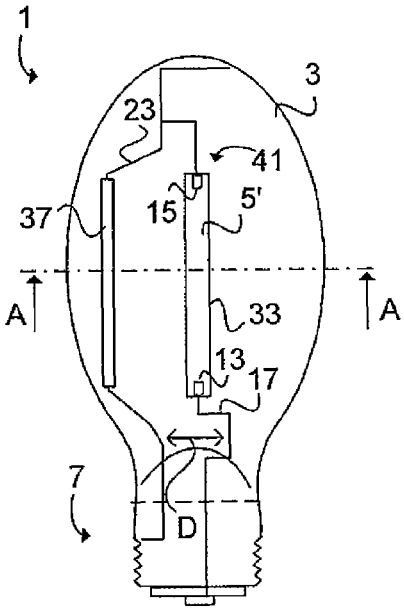
FIG. 4 is a side view of a HPS lamp according to a further embodiment.

FIG. 4 is a side view of a HPS lamp 1 according to a further embodiment, wherein the glass cover 3 comprises two arc tubes 5', 5" (only one is shown in FIG. 4, see also FIGS. 5 and 6) parallel mounted with each other. The second conductor 23, coupled to the top parts 41 of the arc tubes 5', 5", is partly covered by the ceramic cylinder 37 for preventing, during operation of the HPS lamp 1, the photo electronic stream released from the conductor wire 23 otherwise attracted to the arc tube 5' or arc tube 5". This will further be discussed in more detail below.

By mounting two arc tubes 5', 5' in the HPS lamp 1 having the shielded conductor (second conductor wire 23), the life time of the HPS lamp theoretically is doubled. Using a common shielded conductor also saves space in the glass cover 3.

A distance D id provided between the conductor wires 17 and 23 where otherwise those would be close to each other. This arrangement will also in cooperation with the ceramic cylinder 37, reduce the negative influences that otherwise the parallel placement of the metal mount structure makes to the arc tubes under ignition, because the electrical "leak field" between the metal structure and the arc tube for ignition will be reduced due to the larger distance D. The distance D is thus provided with such a measure, such that a major part of the supplied start energy really goes to the arc tube for ignition.

The first step in the ignition process of the HPS lamp 1 is to produce an over voltage that generates an electric discharge within the ignition gas. Since both arc tubes 5', 5" are coupled in parallel, they both are in a position for ignition, but one of them will ignite before the other. When one arc tube 5' has it's arc established, the arc discharge increases the gas temperature within the arc tube 5'. The other arc 5" tube will not ignite since the current follows the established arc in the first ignited arc tube 5'. The arc tube which will ignite first depends upon which one of the both arc tubes 5', 5" having the lowest gas pressure within the arc tube. During manufacture of the arc tubes 5', 5", each arc tube will have it's unique individual pressure being unequal to the others. During the ignition of the HPS lamp 1, that arc tube with the lowest pressure will ignite first. When this arc tube 5' is in operation, the other remains turned out due to the current path via the active arc tube 5' caused by a decrease in the electrical resistance of the arc tube 5'.

When the arc tube 5' is cold, initially during the ignition, a low and intermittent current circulates between the arc tube's 5' electrodes 13, 15 caused by the electrons freed by the photoelectric effect, radiation etc. The breakdown current is reached when the current becomes self-sustained, because each electron liberates at least one other. At this point further increase of the current causes voltage breakdown, the equivalent resistance being negative at this stage. The voltage between the electrodes 13, 15 is typically reduced to under some hundreds of volts and glow discharge takes place. When a drive circuit (not shown) provides the HPS lamp 1 with the necessary power level, a transition from glow discharge to arc occurs. The warm-up time for the HPS lamp 1 is between 3-4 minutes and the restrike time is about one minute.

The high temperature and the high pressure create a diffusion of sodium ions partly through the ends of the arc tube 5 (between the inner wall of the arc tube and the top and bottom ends) and partly through the walls 33 of the arc tube's 5 PCA tube 47 (since ceramic is not permanent resistant and it's microstructure is changing).

This diffusion of sodium ions has a tendency to blackening the arc tube's 5 ceramic wall 33 due to the ion absorption and the pass through of ions. The diffusion is dependent on the occurrence of liberated negative ions from the metal conductor member 23 (the second conductor wire). This liberation of negative ions is due to the intensive radiation from the discharge in the active arc tube 5 under operation. The negative potential during one half wave of the alternating current results in that the negative ions attract to the outside of the PCA tube 47 and charges it negatively. This negative recharging affects the positive sodium ions located nearby the inside of the arc tube 5 with a strong attractive force, which has a tendency to increase the diffusion of sodium ions from the arc tube 5. By means of the shielding member 31 shielding the metal conductor member 23, i.e. not exposing the metal conductor wire to the ignited arc tube 5, less negative ions will attract to the outside of the PCA tube 47 and charging it negatively, wherein less positive sodium ions will be attracted from the arc tube 5, thereby providing the longer life time of the HPS lamp 1. See for the further discussion below related to FIG. 7.

Figure 5:
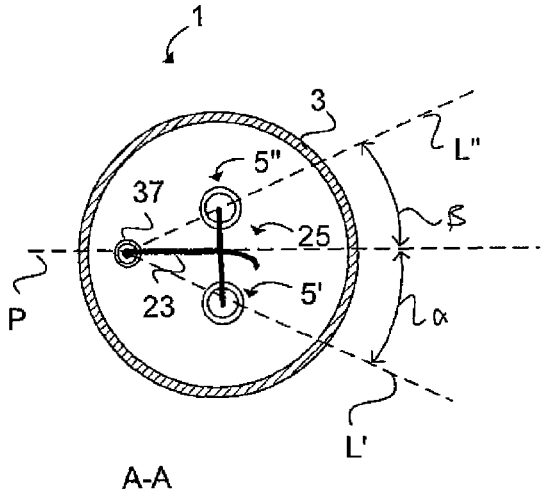
FIG. 5 is a cross section A-A taken through the HPS lamp in FIG. 4.

FIG. 5 is a cross section A-A taken through the HPS lamp 1 in FIG. 4. Here is clearly shown the symmetrical placement of the second metal conductor wire 23, with the ceramic cylinder 37 thread on this second conductor wire 23 (for hindrance of liberation of negative ions from the metallic material of the metal conductor 23 during operation to either of the both arc tubes 5, 5" as being discussed above) relative the both arc tubes 5', 5". An intermediate plane P is imaginary illustrated in FIG. 5 and is drawn halfway between the arc tubes 5', 5". The conductor wire 23, with the ceramic cylinder 37, is placed in the plane P. An angle $\alpha$ is defined between the plane P and a first line L' intercepting the second metal conductor wire 23 (corresponding to the portion provided with the ceramic cylinder 37) and the longitudinal centre line of the first arc tube 5'. An angle $\beta$ is defined between the plane P and a second line L" intercepting the second metal conductor 23 (the same portion of which being enclosed by the ceramic cylinder) and the longitudinal centre line of the second arc tube 5". The angle $\alpha$ corresponds to the angle $\beta$. Thus, the both arc tubes 5', 5" utilize one common shielding member 31.

Figure 6:
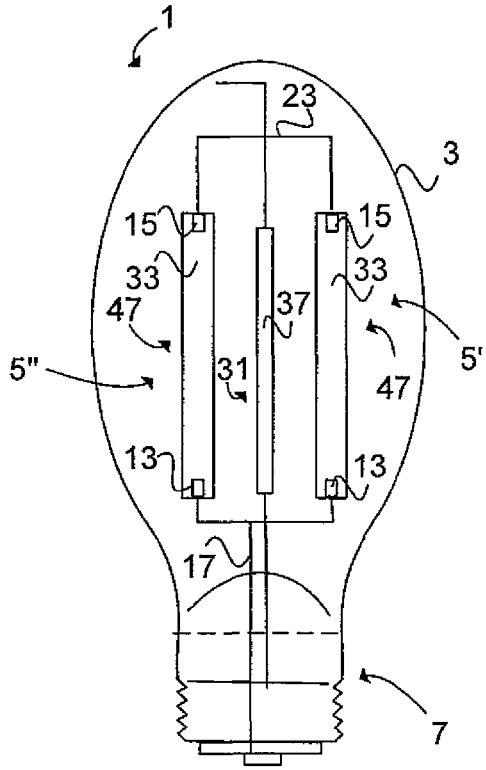
FIG. 6 is a further view of the lamp in FIG. 4 showing a symmetrically placed shielding member between two arc tubes.
Figure 7:
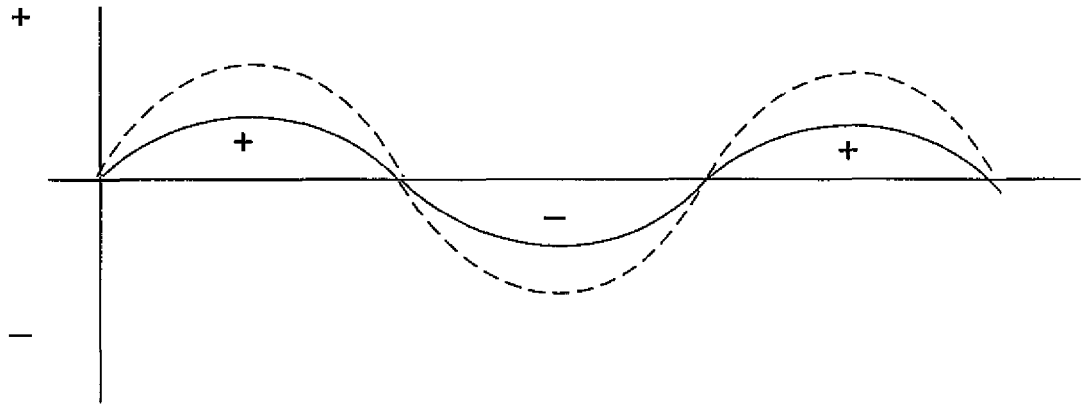
FIG. 7 is a diagram of the inventive principle of reducing the negative potential during one half wave of the alternating current.

FIG. 6 is a further view of the HPS lamp 1 in FIG. 4 showing the symmetrically placed shielding member 31 between two arc tubes 5', 5" and FIG. 7 is a diagram of the principle of reducing the negative potential during one half wave of the alternating current coming from the electrical field between the metal conductor and the active arc tube. The alternating current is shown as a sinusoidal curve with the potential under prior art condition marked with dashed line. Due to the application of the shielding member 31 shielding the metal conductor 23, the potential (marked with continuous line) will be less than the prior art potential. Thus, from the decreased negative potential, less positive sodium ions will be attracted from the arc tube 5, thereby providing the longer life time of the HPS lamp 1.

Figure 8:
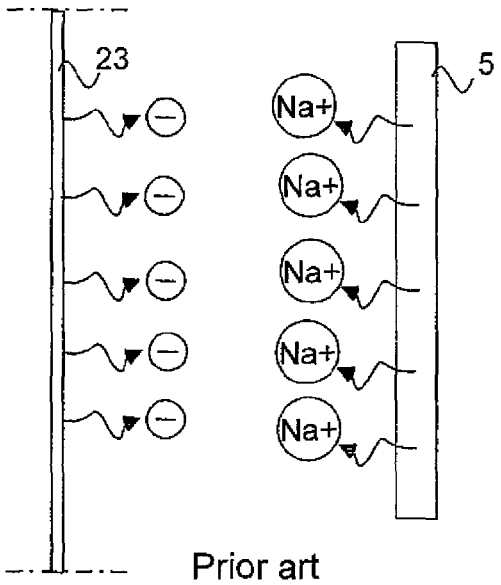
FIG. 8 is an illustrative example showing the strong diffusion of positive sodium ions from the arc tube according to known technique.
Figure 9:
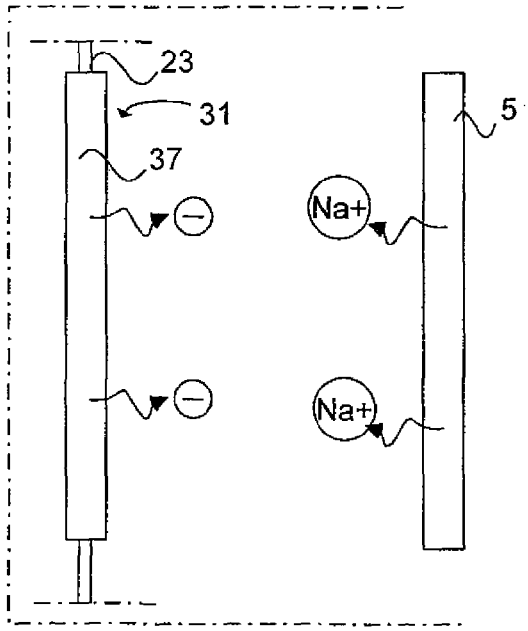
FIG. 9 is an illustrative example of the reduction of the diffusion of positive sodium ions from the arc tube in FIG. 4 during operation.

FIG. 8 is an illustrative example showing the strong diffusion of positive sodium ions (Na+) from the arc tube 5 according to known technique. FIG. 8 shows the state schematically corresponding to the FIG. 7 state with the dashed line marking of large negative potential. A large amount of negative ions is liberated from the metal conductor 23 according to prior art attracting a large amount of positive sodium ions from the active arc tube 5. In FIG. 9 is schematically shown the performance of the shielding member 31. The amount of liberated negative ions is in FIG. 9 very small. The shielding member 31 strongly prevents the liberation of negative ions from the metal conductor 23 connected to the arc tube 5. Thus, a reduction of diffusion of positive sodium ions from the arc tube 5 during operation is achieved, since a less negative recharging will not affect the positive ions within the arc tube 5, as is the case with prior art.

Figure 10A:
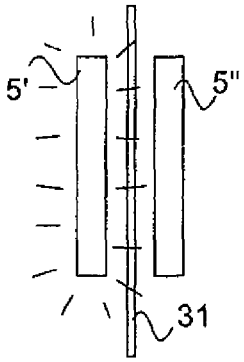
FIGS. 10*a*-10*c* are illustrations showing the principle of the switching between double high pressurized arc tubes mounted with the shielding member.
Figure 10B:
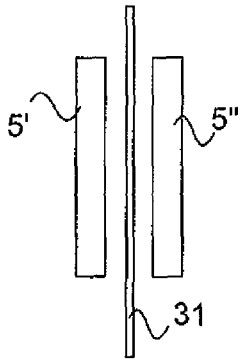
Figure 10C:
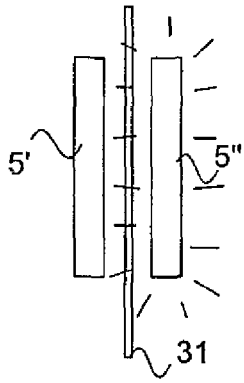

FIGS. 10*a*-10*c* are illustrations showing the principle of the switching between the double high pressure arc tubes 5', 5" mounted with the shielding member 31, for shielding the conductor member connected to the arc tubes 5'. 5" shown in FIG. 6. FIG. 10*a* shows the high pressure arc tube 5' igniting first (depending upon which one of the both high pressure arc tubes 5'. 5" which have the lowest gas pressure). In this case it is the left high pressure arc tube 5'. During operation of the HPS lamp 1 this left high pressure arc tube 5' will have a temperature of about 1100° C. and the pressure within this active left high pressure arc tube 5' will be higher than the other (than that on the right hand on the drawing) high pressure arc tube 5" not being active.

In case of momentary power outage, as is schematically illustrated in FIG. 10*b*, the left high pressure arc tube 5', and thereby also the HPS lamp 1, will be turned off. In this state, the left high pressure arc 5' tube will be warmer than the right high pressure arc tube 5". Thereby the pressure within the right high pressure arc tube 5" will be less than the pressure within the left high pressure arc tube 5'.

When the current shortly thereafter is brought to the HPS lamp 1, the right high pressure arc tube 5" will more easily ignite because this has the lowest pressure, due to that it has the lowest temperature relative the left one, as is shown schematically in FIG. 10*c*. Thus the HPS lamp 1 will have an increased life time due to the alternating ignition of the high pressure arc tubes mounted parallel, which high pressure arc tubes 5', 5" also have a common conductor wire 23 and a common shielding member 31 adjacent the conductor wire 23, and shielding the conductor wire 23 so that it is not exposed to the both high pressure arc tubes 5', 5". That is, the shielding member 31 is adapted for co-operation with both the high pressure arc tubes, alternately operating during the life time of the HPS lamp 1.

Due to the shielding member 31 providing for the reduction of blackening of the high pressure arc tube 5' as being discussed above, the temperature of the other high pressure arc tube 5" to be ignited will be lower and thereby the HPS lamp 1 will more easily ignite in case of momentary power outage. This beneficial when the high pressure lamp is mounted in a streetlighting armature and the street traffic is depended upon the production of light.

Figure 11:
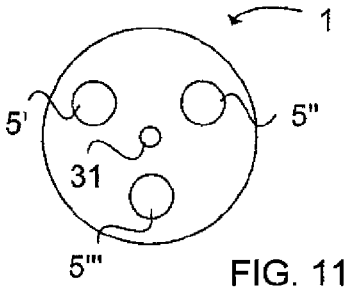
FIG. 11 is a top view of a HPS lamp having three high pressurized arc tubes symmetrically disposed around a common conductor.

FIG. 11 is a top view of a HPS lamp 1 having three high pressure arc tubes 5', 5", 5'" symmetrically disposed around a common conductor and having a common shielding member 31. This arrangement theoretically treble the life time of the HPS lamp 1.

Figure 12:
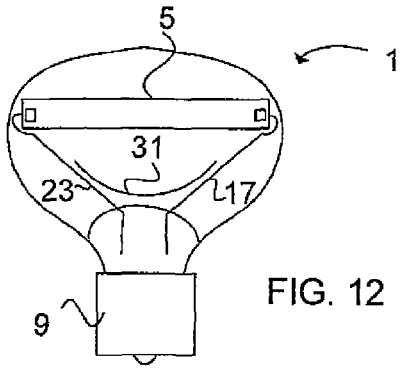
FIG. 12 is a side view of a HPS lamp according to an additional embodiment.

FIG. 12 is a side view of a HPS lamp 1 according to an additional embodiment. This embodiment schematically shows the arrangement of a shielding member 31 shielding both conductor members 17, 23. The shielding member 31 is a ceramic coating adjacent (or directly onto) arranged to the conductor members 17, 23.

The present invention is of course not in any way restricted to the preferred embodiments described above, but many possibilities to modifications, or combinations of the described embodiments, thereof should be apparent to a person with ordinary skill in the art without departing from the basic idea of the invention as defined in the appended claims. For example, monolithic arc tube designs, wherein the body and end parts are a single unit, can also be used without leaving the scope of the invention. Furthermore, sintered electrodes can be used for the arc tube instead for tungsten coiled electrodes.

The invention claimed is:

1. A high pressure sodium lamp comprising:

an evacuated cover including a base part, a first arc tube and a second arc tube each comprising a first electrode coupled to the base part by a first conductor member and a second electrode coupled to the base part by a second conductor member, the first arc tube and the second arc tube mounted parallel with each other, the second conductor member symmetrically arranged between the first arc tube and the second arc tube and isolated by a shielding member, wherein the shielding member is a cylinder made of ceramic surrounding the second conductor member and having only the second conductor member within the cylinder, and wherein the shielding member is held in place on the second conductor member without the need of additional fittings, wherein the shielding member is arranged for preventing, during operation of the high pressure sodium lamp, the photo electronic stream from the second conductor member to the first arc tube and the second arc tube, and wherein the second conductor member lies in an intermediate plane, the intermediate plane extending between the first arc tube and the second arc tube such that a first line intercepting the second conductor member and a longitudinal center line of the first arc tube forms an angle alpha with the intermediate plane, and a second line intercepting the second conductor member and a longitudinal center line of the second arc tube forms an angle beta with the intermediate plane, wherein the angle alpha corresponds to the angle beta.

2. The high pressure sodium lamp according to claim 1, wherein the ceramic is steatite.

3. The high pressure sodium lamp according to claim 1, wherein the second conductor member serves as a mounting structure having a part abutting against a portion of the cover opposite from the base part.

4. The high pressure sodium lamp according to claim 1, wherein the first arc tube and the second arc tube include xenon under a gas pressure of about 120-150 mbar.

5. The high pressure sodium lamp according to claim 1, wherein at least one of the first arc tube and the second arc tube comprises xenon under a gas pressure of about 130-140 mbar.

6. The high pressure sodium lamp according to claim 1, wherein the shielding member is arranged parallel to the first arc tube and to the second arc tube, and with essentially the same extension as at least one of the first arc tube and the second arc tube.

7. A high pressure sodium lamp comprising:

an evacuated cover including a base part, a first arc tube and a second arc tube each comprising a first electrode coupled to the base part by a first conductor member and a second electrode coupled to the base part by a second conductor member, the first arc tube and the second arc tube mounted parallel with each other, the second conductor member symmetrically arranged between the first arc tube and the second arc tube and isolated by a shielding member, wherein the shielding member is arranged for preventing, during operation of the high pressure sodium lamp, the photo electronic stream from the second conductor member to the first arc tube and the second arc tube, and wherein the second conductor member lies in an intermediate plane, the intermediate plane extending between the first arc tube and the second arc tube such that a first line intercepting the second conductor member and a longitudinal center line of the first arc tube forms an angle alpha with the intermediate plane, and a second line intercepting the second conductor member and a longitudinal center line of the second arc tube forms an angle beta with the intermediate plane, wherein the angle alpha corresponds to the angle beta.

8. The high pressure sodium lamp according to claim 7, wherein at the time of manufacture the, first arc tube has a first individual pressure within the first arc tube and the second arc tube has a second individual pressure within the second arc tube, the first individual pressure being unequal to the second individual pressure.

* * * * *